US005337762A

United States Patent [19]

Jedamski

[11] Patent Number: 5,337,762

[45] Date of Patent: Aug. 16, 1994

[54] APPARATUS FOR STORING AND DISTRIBUTING COMMINUTED TOBACCO

[75] Inventor: Karsten Jedamski, Moorrege, Fed. Rep. of Germany

[73] Assignee: Korber AG, Hamburg, Fed. Rep. of Germany

[21] Appl. No.: 54,527

[22] Filed: Apr. 28, 1993

[30] Foreign Application Priority Data

Apr. 30, 1992 [DE] Fed. Rep. of Germany ..... 4214463

[51] Int. Cl.[5] ..... A24C 5/39

[52] U.S. Cl. ..... 131/108; 131/109.3; 198/750; 198/752; 198/759; 198/766; 222/199; 222/200

[58] Field of Search ..... 131/108, 109.2, 109.3, 131/110, 84.1, 84.3; 222/199, 200; 198/750, 752, 756, 759, 766, 769; 406/75; 74/664; 366/108, 216

[56] References Cited

U.S. PATENT DOCUMENTS 3,473,759 10/1969 Spiess ..... 198/769 X
4,390,029 6/1983 Leckband et al. ..... 131/108 X

FOREIGN PATENT DOCUMENTS 1432726 11/1968 Fed. Rep. of Germany ..... 131/108
74110 11/1944 Switzerland ..... 74/664

*Primary Examiner*—Jennifer Bahr
*Attorney, Agent, or Firm*—Darby & Darby

[57] ABSTRACT

An apparatus for temporarily storing and distributing comminuted tobacco to a plurality of consuming machines (particularly for distributing cut tobacco to cigarette rod making machines) has a circular tray which receives batches of comminuted tobacco at regular or irregular intervals and is caused to perform movements resulting in conversion of stored tobacco particles into a fluidized bed. Upwardly extending suction pipes draw tobacco particles from the fluidized bed for delivery to the respective consuming machines. The mechanism for moving the tray comprises at least three identical eccentrics which are rotatable in vertical planes and are installed at the underside of the marginal portion of the bottom wall of the tray substantially in line with the inlets of the suction pipes. The eccentrics have identical throws and are mounted in spherical bearings which are secured to the bottom wall by hinges for pivotal movement about horizontal axes extending tangentially of the tray. The eccentrics are rotated by a motor which drives a first bevel gear coaxial with the tray, and the first bevel gear mates with and transmits torque to additional bevel gears, one for each eccentric and each connected with a shaft which carries the respective eccentric.

13 Claims, 1 Drawing Sheet

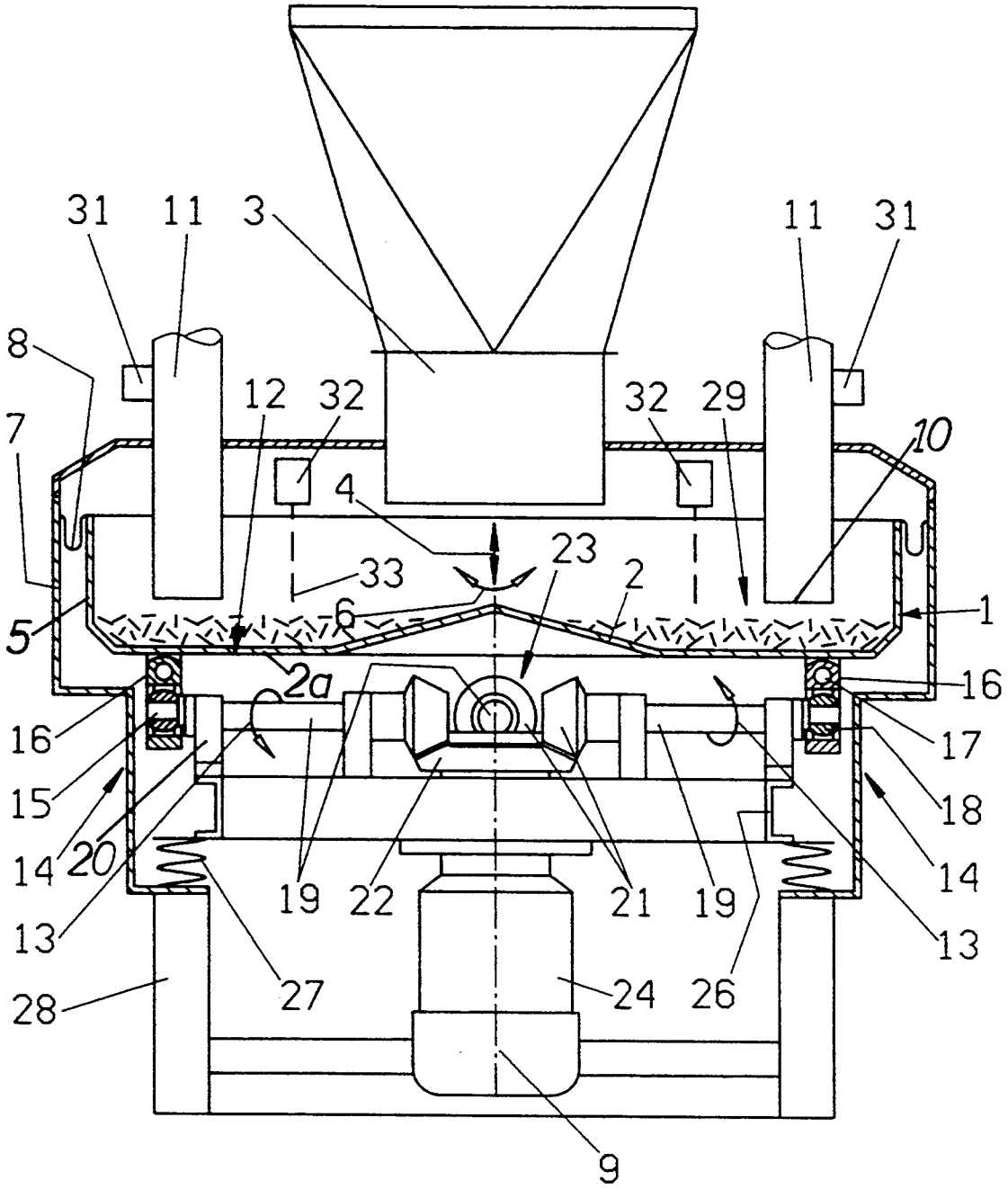
31
11
3
11
31
8
12
32
32
29
10
7
4
23
33
2
5
6
1
2a
16
16
17
15
18
14
20
14
19
22
21
19
13
13
28
27
24
26
9

APPARATUS FOR STORING AND DISTRIBUTING COMMINUTED TOBACCO

BACKGROUND OF THE INVENTION

The invention relates to improvements in apparatus for temporarily storing comminuted tobacco and for distributing such tobacco to a plurality of consuming machines. More particularly, the invention relates to improvements in apparatus which can be utilized for temporary storage of cut tobacco prior to transport into the magazines of cigarette rod making or like tobacco consuming or processing machines.

Commonly owned U.S. Pat. No. 4,390,029 granted Jun. 28, 1983 to Uwe Leckband et al. for "Apparatus for storing and transporting comminuted tobacco or the like" discloses an apparatus wherein a reservoir is vibrated to convert a supply of comminuted tobacco therein into a fluidized bed. A set of suction pipes (at least one for each consuming machine) extends downwardly into the reservoir, and such pipes are activated when necessary to draw tobacco particles from the fluidized bed for pneumatic delivery to the magazines of the respective consuming machines. The reservoir is agitated by causing it to move up and down and/or by causing streamlets of air to rise into the reservoir through its foraminous bottom wall. The disclosure of the patent to Leckband et al. is incorporated herein by reference.

OBJECTS OF THE INVENTION

An object of the invention is to provide an apparatus which is constructed and assembled in such a way that it can deliver requisite quantities of comminuted tobacco of optimum consistency to a large number of consuming machines.

Another object of the invention is to provide an apparatus which constitutes an improvement over and a further development of apparatus of the type disclosed by Leckband et al.

A further object of the invention is to provide an apparatus which can satisfy the requirements of a large number of modern cigarette makers serving to process huge quantities of comminuted tobacco per unit of time.

An additional object of the invention is to provide the apparatus with novel and improved means for establishing and maintaining a uniform fluidized bed of comminuted tobacco, particularly cut tobacco which is ready for delivery to cigarette rod making and like machines.

Still another object of the invention is to provide a compact apparatus which can satisfy the requirements of a large number of consuming machines in spite of its relatively small size.

A further object of the invention is to provide a novel and improved method of agitating a reservoir for cut tobacco.

Another object of the invention is to provide a novel and improved arrangement of eccentrics for use in the agitating means for the reservoir in the above outlined apparatus.

A further object of the invention is to provide a production line which employs an apparatus of the above outlined character.

Another object of the invention is to provide a novel and improved combination of two or more cigarette rod making machines and an apparatus for temporary storage and distribution of cut tobacco to such machines.

An additional object of the invention is to provide a novel and improved reservoir for use in the above outlined apparatus.

Still another object of the invention is to provide an apparatus which can be used for temporary storage and distribution of a variety of comminuted tobaccos.

SUMMARY OF THE INVENTION

The invention is embodied in apparatus for supplying comminuted tobacco to a plurality of consuming machines, particularly for supplying cut tobacco to a plurality of cigarette rod making machines. The improved apparatus comprises a reservoir having a central vertical axis, means for feeding comminuted tobacco into the reservoir, and means for converting at least the major part of tobacco in the reservoir into a fluidized bed. The converting means comprises at least three eccentrics which can be said to support the reservoir and are equidistant from the central axis and are spaced apart from each other about such axis. The eccentrics are rotatable in vertical planes and the converting means further comprises means for rotating the eccentrics. The improved apparatus further comprises means for pneumatically conveying comminuted tobacco from the fluidized bed in the reservoir to the consuming machines. The reservoir preferably comprises a bottom wall with a substantially centrally disposed raised conical portion beneath the feeding means, and the conveying means has inlets adjacent an annular portion of the bottom wall which surrounds the conical portion. The eccentrics preferably have identical eccentricities.

The eccentrics are preferably equidistant from each other about the central axis of the reservoir, and the converting means preferably comprises four eccentrics which are spaced apart from each other about the central axis by substantially 90 degrees.

The means for rotating the eccentrics preferably comprises a common central driving unit for the eccentrics, and such driving unit can comprise a bevel gear transmission having a driver gear coaxial with the reservoir and driven gears mating with the driver gear and each connected with one of the eccentrics. The driving unit further comprises a prime mover for the driver gear and a shaft connecting each driven gear with the respective eccentric.

The eccentrics have identical throws and are rotatable about additional axes which are substantially normal to the central axis of the reservoir. All of the eccentrics preferably have identical angular positions with reference to the respective additional axes, i.e., they simultaneously assume their highest, lowest or any intermediate positions.

The reservoir preferably comprises a substantially circular peripheral wall, and the eccentrics are preferably adjacent such peripheral wall.

The converting means preferably further comprises bearings, such as spherical bearings, which are carried by the bottom wall of the reservoir and each of which mounts one of the eccentrics. The inlets of the conveying means are adjacent the bottom wall above the bearings. The converting means also comprises means for articulately connecting the bearings to the bottom wall, and such means for articulately connecting preferably comprises hinges which define substantially horizontal pivot axes for the respective bearings. The inlets of the conveying means preferably form an annulus which is concentric with the reservoir.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a schematic partly elevational and partly central vertical sectional view of an apparatus which embodies one form of the invention and wherein the means for converting the supplied tobacco particles into a fluidized bed comprises four equidistant eccentrics mounted at the underside of the annular outer portion of the bottom wall of the reservoir for comminuted tobacco.

DESCRIPTION OF PREFERRED EMBODIMENTS

The apparatus which is shown in the drawing comprises a circular reservoir 1 in the form of a tray having a horizontal bottom wall 12 with a centrally located raised conical portion 2 and an annular portion 2a between the conical portion 2 and a substantially circular peripheral wall 5. The conical portion 2 of the bottom wall 12 is located beneath the discharge end of a device 3 serving as a means for feeding comminuted tobacco into the tray 1. The device 3 can discharge batches of comminuted tobacco by gravity flow whenever the upper level of the supply of comminuted tobacco in the tray 1 descends below a preselected value. At least one level detector 32 of any known design can be used to discharge one or more beams 33 of radiation (the drawing shows two detectors 32). Such radiation is reflected by the upper surface of the body of comminuted tobacco particles in the tray 1, and the intensity of reflected radiation is related to the quantity of tobacco in the tray. The detectors 32 trigger the admission of one or more batches of tobacco through the device 3 and onto the conical central portion 2 of the bottom wall 12 when the supply of tobacco in the tray 1 is depleted to a preselected minimum acceptable value.

The wall 5 of the tray 1 is surrounded by a sealing diaphragm 8 which engages or is affixed to the adjacent wall 7 of a housing forming part of the improved apparatus and confining the tray 1. The device 3 extends through the top wall of the housing, the same as several upright pipes 11 constituting means for pneumatically conveying (when necessary) comminuted tobacco from the tray 1 to a plurality of consuming machines (not shown), for example, for pneumatically conveying cut tobacco to a plurality of discrete cigarette rod making machines of the type known as PROTOS (produced and distributed by the assignee of the present application). The inlets 10 at the lower ends of the pipes 11 preferably form an annulus whose center is located on the central vertical axis 9 of the tray 1. The latter can perform movements in directions indicted by double-headed arrows 4 and 6.

The means for converting the supply of comminuted tobacco above the bottom wall 12 of the tray 1 into a fluidized bed 29 of tobacco particles (i.e., for imparting to the tray movements in directions indicated by the arrows 4 and 6) includes at least three identical eccentrics 14 which are installed at the underside of the bottom wall 12 at identical distances from the axis 9. The converting means of the illustrated apparatus comprises four eccentrics 14 which are disposed at the same radial distance from the axis 9 and are equidistant from each other about such axis, i.e., in the circumferential direction of the wall 5. The distances of the eccentrics 14 from the axis 9 preferably match or at least approximate the radius of an annulus defined by the inlets 10 of the pipes 11. The eccentrics 14 are rotatable about horizontal axes (note the arrows 13) which are normal to and cross each other at the central axis 9. Each eccentric 14 is rotatable in a vertical plane and is journalled in a joint 16 which, in turn, is mounted at the underside of the bottom wall 12 by a connecting means 17 in the form of a hinge defining a horizontal pivot axis for the respective joint 16. The axes of the hinges 17 are normal to the horizontal axes (arrows 13) of the respective eccentrics 14, and each joint 16 includes a spherical bearing 18 for the pin 15 of the corresponding eccentric 14.

Each eccentric 14 is provided at the outer end of a radially extending shaft 19 which has an inner end portion affixed to, or of one piece with, a driven bevel gear 21 forming part of a driving unit 23 here shown as a bevel gear transmission. The transmission 23 further comprises a vertical driver gear 22 which is coaxial with the tray 1 and is driven by a electric motor 24 or another suitable prime mover. The horizontal shafts 19 are rotatable in bearings 20 carried by a frame 26 mounted on springs 27 which are supported by a stationary base 28. The housing including the wall 7 is also mounted on the base 28.

Each of the pipes 11 carries a pneumatic (suction-operated) switch 31 which serves to start the prime mover 24 when the respective consuming machine is to receive a supply of tobacco particles from the fluidized bed 29 at the upper side of the bottom wall 12 of the tray 1. The prime mover 24 then begins to rotate the eccentrics 14 which have identical throws and are mounted on the respective shafts 19 in identical orientation. Thus, all four eccentrics 14 simultaneously assume their uppermost positions, their lowermost positions and each of their intermediate positions.

It has been found that the illustrated apparatus can rapidly establish a highly satisfactory fluidized bed 29 in response to starting of the prime mover 24 by one of the switches 31 to ensure that the respective pipe or pipes 11 will draw a mass of homogeneously distributed tobacco particles as long as is necessary to replenish the supply of tobacco particles in the respective consuming machine or machines. The aforedescribed converting means including the prime mover 24 and the eccentrics 14 further ensures that the fluidized bed 29 remains intact upon removal of a quantity of uniformly distributed floating tobacco particles for delivery to one or more consuming machines. The particles spread out between the axis 9 and the wall 5 not only when one or more pipes 11 are in the process of drawing tobacco particles from the fluidized bed 29 but as long as the prime mover 24 is on, i.e., as long as the eccentrics 14 are rotated to move the tray 1. These eccentrics impart to the bottom wall 12 of the tray 1 movements in the following way:

The tray 1 is compelled to move up and down as indicated by the arrow 4 at twice the amplitude of the eccentrics 14, i.e., through distances twice the eccentricity of an eccentric 14. At the same time, the tray 1 performs oscillatory back and forth movements about the central vertical axis 9, namely in directions indicated by the arrow 6. Thus, the reciprocatory and oscillatory movements of the tray 1 are superimposed upon each other. This causes different minute portions (points) of the tray 1 to perform different movements, namely the movements of a point nearer to the axis 9 are different from those of a point nearer to the wall 5. Thus, a point at or close to the axis 9 basically performs a simple up-and-down movement as indicated by the double-headed arrow 4. On the other hand, a point which is spaced apart from the axis 9 performs a movement along a substantially elliptical path. The vertically extending minor axis of the elliptical path matches the eccentricity of the eccentrics 14. On the other hand, the horizontal major axis of the elliptical path increases from the axis 9 (where it equals zero) toward the peripheral wall 5. Those points of the tray 1 which are located at the eccentrics 14 perform a circular movement.

The aforementioned detector or detectors 32 are operative at least subsequent to evacuation of a certain quantity of tobacco particles from the fluidized bed 29 in order to ensure that the replenishment of the supply of tobacco through the device 3 and onto the conical central portion 2 of the bottom wall 12 is started not later than when the supply of tobacco particles in the tray 1 descends to a selected lowermost permissible level.

An important advantage of the improved apparatus is that, in spite of its compactness, it can satisfy the requirements of a large number of consuming machines (each such machine can receive tobacco particles through one or more pipes 11) as well as that the apparatus can prepare a highly satisfactory fluidized bed with optimal distribution of tobacco particles therein. The particles are loose, and different types of particles are thoroughly intermixed to constitute a highly satisfactory blend ready for admission to one or more consuming machines. Moreover, any gaps which tend to develop in the fluidized bed 29 as a result of delivery of particles to one or more consuming machines are continuously closed or filled to ensure that the quality of the fluidized bed 29 remains unchanged.

It often suffices if the means for converting the batches of tobacco descending through the device 3 into a fluidized bed 29 comprises only three eccentrics 14 which are disposed at angles of 120 degrees relative to each other (as seen in the circumferential direction of the wall 5 forming part of the tray 1). However, it is presently preferred to employ converting means with more than three equidistant eccentrics 14.

The driving unit 23 can be used to rotate the shafts 19 in a clockwise direction or in a counterclockwise direction without altering the aforediscussed composite movements of the trough 1 in directions indicated by the arrows 4 and 6. Though it is possible to employ a discrete driving unit for each eccentric 14 or to employ a discrete driving unit for each pair of eccentrics and to properly synchronize the movements of such plural driving units, it is presently preferred to employ a single driving unit 23 because this contributes to simplicity, compactness and lower cost of the apparatus.

The positioning of the eccentrics 14 at the same radial distance from the central vertical axis 9 as the positioning of the inlets 10 of the pipes 11 and close to the peripheral wall 5 of the tray 1 brings about a number of advantages. Thus, all such portions of the tray 1 which are located on circles having identical radii perform identical movements. This contributes to stabilization of the fluidized bed 29 and to rapid development of such bed in response to starting of the prime mover 24.

The provision of spherical bearings 18 for the pins 15 of the eccentrics 14 is desirable and advantageous because this compensates for radial displacement of the bearings in the course of oscillatory back-and-forth movements of the tray 1 in directions indicated by the arrow 6.

In order to reduce the wear upon the eccentrics 14 and upon their bearings (the wear develops primarily as a result of relatively small axial displacement of the eccentrics in their bearings), it is often advisable to make the eccentrics and/or the bearings therefor of a self-lubricating or other suitable material, such as polyamide. Thus, each bearing can include a sleeve consisting of or containing polyamide or a material exhibiting similar desirable characteristics for the purposes of reducing wear as a result of frictional engagement with the adjacent part or parts. The aforementioned mounting of the bearings 18 in hinges 17 which are secured to the bottom wall 12 of the tray 1 also contributes to a reduction of wear. Thus, the hinges 17 permit angular movements about axes which are normal to the axes of rotation of the eccentrics 14 so that the eccentrics can be held in fixed axial positions because any lateral deflecting forces are compensated for by corresponding pivotal movements of the hinges in the radial direction of the tray 1.

The aforedescribed movements of the tray 1 in response to starting of the prime mover 24 have been found to ensure the establishment and maintenance of a highly satisfactory fluidized bed 29 even in the (normally rather unlikely) event that a large number of consuming machines are simultaneously in need of receiving fresh supplies of properly distributed tobacco particles. The centrally located conical portion 2 of the bottom wall 12 also contributes to rapid and uniform distribution of tobacco particles in the radial and circumferential directions of the tray 1. Thus, the tray 1 (which can be said to constitute a torsional vibrator) satisfies all of the requirements concerning the generation of a highly satisfactory fluidized bed including proper distribution in the circumferential direction of the wall 5, uniform distribution in the radial direction between the central vertical axis 9 and the wall 5, as well as rapid closing of any gaps which tend to develop in response to removal of tobacco particles by one or more pipes 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for supplying comminuted tobacco to a plurality of consuming machines, comprising a reservoir having a central vertical axis, a substantially circular peripheral wall and a bottom wall with a substantially centrally disposed raised conical portion; means for simultaneously imposing up-and-down movements and oscillatory horizontal back-and-forth movements on said reservoir for converting at least a major part of tobacco in said reservoir into a fluidized bed, comprising at least three eccentrics having at least substantially identical eccentricities, being adjacent said peripheral wall, supporting said reservoir and being equidistant about said axis, said eccentrics being rotatable in vertical planes and said converting means further comprising means for rotating said eccentrics; and means for pneumatically conveying comminuted tobacco from the fluidized bed to the consuming machines, said conveying means having inlets adjacent a portion of said bottom wall surrounding said raised conical portion.

2. The apparatus of claim 1, wherein said eccentrics are substantially equidistant from each other about said axis.

3. The apparatus of claim 2, wherein said converting means comprises four eccentrics which are spaced apart from each other about said axis by substantially 90 degrees.

4. The apparatus of claim 1, wherein said means for rotating comprises a con, non central driving unit for said eccentrics.

5. The apparatus of claim 1, wherein said eccentrics have identical throws and are rotatable about additional axes substantially normal to said central axis, all of said eccentrics having identical angular positions with reference to the respective additional axes.

6. The apparatus of claim 1, wherein said bottom wall is adjacent said eccentrics, said converting means further comprising bearings carried by said bottom wall and each mounting one of said eccentrics, said inlets being disposed above said bearings.

7. The apparatus of claim 1, wherein said bottom wall is adjacent said eccentrics, said converting means further comprising spherical bearings for said eccentrics, said bearings being provided on said bottom wall.

8. The apparatus of claim 1, wherein said inlets together form an annulus which is concentric with said reservoir.

9. The apparatus of claim 1, wherein said eccentrics are oriented such that the portion of said reservoir which is disposed at said axis generally performs up-and-down movements whereas portions of said reservoir which are spaced apart from said axis perform movements substantially along elliptical paths in response to rotation of said eccentrics, said elliptical paths having substantially vertically extending minor axes of a length at least substantially matching the eccentricity of said eccentrics and substantially horizontally extending major axes which increase in length from said axis to said peripheral wall.

10. Apparatus for supplying comminuted tobacco to a plurality of consuming machines, comprising a reservoir having a central vertical axis; means for feeding comminuted tobacco into said reservoir; means for converting at least the major part of tobacco in said reservoir into a fluidized bed, comprising at least three eccentrics having identical eccentricities, supporting said reservoir and being equidistant from said axis and being spaced apart from each other about said axis, said eccentrics being rotatable in vertical planes and said converting means further comprising means for rotating said eccentrics, said means for rotating comprising a common central driving unit for said eccentrics, said driving unit comprising a bevel gear transmission having a driver gear coaxial with said reservoir and driven gears mating with said driver gear and each connected with one of said eccentrics; and means for pneumatically conveying comminuted tobacco from the fluidized bed to the consuming machines.

11. The apparatus of claim 10, wherein said driving unit further comprises a prime mover for said driver gear and a shaft connecting each driven gear with the respective eccentric.

12. Apparatus for supplying comminuted tobacco to a plurality of consuming machines, comprising a reservoir having a central vertical axis and a bottom wall; means for feeding comminuted tobacco into said reservoir; means for converting at least the major part of tobacco in said reservoir into a fluidized bed, comprising at least three eccentrics having identical eccentricities, being adjacent said bottom wall, supporting said reservoir, being equidistant from said axis and being spaced apart from each other about said axis, said eccentrics being rotatable in vertical planes and said converting means further comprising means for rotating said eccentrics and spherical bearings for said eccentrics, said bearings being provided on said bottom wall and said converting means further comprising means for articulately connecting said bearings to said bottom wall; and means for pneumatically conveying comminuted tobacco from the fluidized bed to the consuming machines.

13. The apparatus of claim 12, wherein said means for articulately connecting comprises hinges defining substantially horizontal pivot axes for the respective bearings.

* * * * *